US005973586A

United States Patent [19]

Mertler, Jr.

[11] Patent Number: 5,973,586

[45] Date of Patent: Oct. 26, 1999

[54] TEMPERATURE SENSITIVE TIP-SWITCH

[75] Inventor: Charles Stanley Mertler, Jr., Norwalk, Ohio

[73] Assignee: Tower Manufacturing Corporation, Providence, R.I.

[21] Appl. No.: 09/213,167

[22] Filed: Dec. 17, 1998

[51] Int. Cl.[6] ..... H01H 37/02; H01H 37/12; H01H 37/52

[52] U.S. Cl. ..... 337/299; 337/347; 337/337; 337/360

[58] Field of Search ..... 337/299, 337, 337/347, 360, 333, 67, 68, 82, 85, 374, 375, 361, 362

[56] References Cited

U.S. PATENT DOCUMENTS

| | | | |
|---|---|---|---|
| 3,236,977 | 2/1966 | Huffman | 337/337 |
| 3,354,278 | 11/1967 | Piacent et al. | 337/84 |
| 3,451,029 | 6/1969 | Levinn et al. | 337/349 |
| 3,452,312 | 6/1969 | Bauer | 337/12 |
| 3,913,048 | 10/1975 | Mertler | 337/67 |
| 3,936,786 | 2/1976 | Peterson et al. . | |
| 3,964,004 | 6/1976 | Mertler . | |
| 4,103,269 | 7/1978 | Grable et al. . | |
| 4,166,994 | 9/1979 | DeRemer . | |
| 4,259,655 | 3/1981 | Balchunas . | |
| 4,285,145 | 8/1981 | Balchunas . | |
| 4,345,389 | 8/1982 | Balchunas . | |
| 4,968,963 | 11/1990 | DeWitt et al. . | |
| 5,457,444 | 10/1995 | Cook . | |
| 5,517,165 | 5/1996 | Cook . | |

*Primary Examiner*—Leo P. Picard
*Assistant Examiner*—Anatoly Vortman
*Attorney, Agent, or Firm*—Kreigsman & Kriegsman

[57] ABSTRACT

In one embodiment of the present invention, a temperature sensitive tip switch comprises a first conductive arm, a second conductive arm disposed in a parallel, spaced apart relation beneath the first conductive arm, a third conductive arm disposed in a parallel relation beneath the second conductive arm, and a temperature sensitive actuator blade disposed in a parallel, spaced apart relation beneath the third conductive arm. The second conductive arm includes a cut-out portion which is capable of downward flexion and the third conductive arm includes a cut-out portion which is capable of downward flexion and which is engaged with the cut-out portion in the second conductive arm. A first pair of normally closed, electrical contacts are mounted on the actuator blade and the third conductive arm. A second pair of normally closed, electrical contacts are mounted on the second conductive arm and the first conductive arm. In use, an adjustable thermostat shaft assembly is disposed to contact and selectively urge the cut-out portion in the second conductive arm in a downward direction so as to open the first pair of electrical contacts in a fast-action manner. In addition, an insulated button is mounted on the actuator blade and is disposed to contact and selectively urge the third conductive arm upwards upon the application of heat so as to open the first pair of electrical contacts in a fast-action manner. Furthermore, a gravity sensitive tip-over device is mounted on the actuator blade and is disposed to selectively urge the first conductive arm away from the second conductive arm upon a change in the orientation of the switch so as to open the second pair of electrical contacts.

22 Claims, 7 Drawing Sheets

TEMPERATURE SENSITIVE TIP-SWITCH

BACKGROUND OF THE INVENTION

The present invention relates generally to switches and, more particularly, to temperature responsive tip-switches.

Switches are well-known electromechanical devices which are commonly used to open and close electrical circuits.

One well-known type of switch is a temperature sensitive switch. Temperature sensitive switches, such as a thermostat, typically comprise a temperature sensor which is used to open or close electrical contacts at specified temperatures. Typically, a bimetal strip of dissimilar metals is used as the sensing element for temperature sensitive switches. The bimetal strip of dissimilar metals tends to curve upon a change in temperature due to the different rates of expansion of the dissimilar metals. The curvature of the bimetal strip is then used to open and close the electrical circuit accordingly.

Temperature sensitive switches are often used for thermal protection purposes. For example, if a device gets too hot, the temperature sensitive switch opens the electrical circuit, thereby eliminating power to the circuit.

Another well-known type of switch is a gravity sensitive, or tip-over, switch. Gravity sensitive switches, such as liquid mercury button tip switches, typically comprise a gravity sensitive element which detects movement and accordingly, opens or closes electrical contacts for the electrical circuit in response to the movement.

Switches having temperature sensitive and gravity sensitive properties, such as temperature responsive tip-switches, are well-known in the art and are commonly used to control alternating current circuits for a variety of applications. For example, temperature responsive tip-switches are particularly useful in connection with electric heaters.

In U.S. Pat. No. 3,964,004 to C. S. Mertler, there is disclosed a combined thermostatic switch and tilt switch is disclosed which is of the stack type with slow make and break contacts. A temperature responsive element such as a bimetal actuates a set of contacts and an attitude responsive means such as a swingable pendulum also actuates a set of contacts. These two responsive means may actuate the same set of contacts or may actuate different sets of contacts in various embodiments of the invention, but a second set of contacts is provided in the switch as a standby set of contacts which may be actuated by one of the responsive means in the event that the first set of contacts fails to be actuated, e.g. by being welded together or some other malfunction.

Temperature responsive tip-switches are highly desirable because a single switch provides both temperature and gravity responsive interruption for an electrical circuit. As a consequence, temperature responsive tip-switches can considerably reduce the overall size and cost to manufacture the device which utilizes the temperature responsive tip-switch.

It should be noted that temperature responsive tip-switches of the type described above often experience a notable drawback. Specifically, temperature responsive tip-switches of the type described above typically comprise a slow-action thermostat which uses slow make and break constructions to open and close its electrical contacts. As a result, the switching process can be relatively slow, which can be undesirable due to the possibility of excessive contact arcing resulting in reduced contact life and radio noise interference.

SUMMARY OF THE INVENTION

It is an object of the present invention to provide a new and improved electric switch.

It is another object of the present invention to provide an electric switch which provides temperature responsive circuit interruption.

It is yet another object of the present invention to provide an electric switch as described above which provides gravity responsive circuit interruption.

It is still another object of the present invention to provide an electric switch as described above in which the temperature responsive and gravity responsive portions of the switch are independent.

It is a further object of the present invention to provide an electric switch as described above which provides quick switching capabilities.

It is yet another object of the present invention to provide an electric switch as described above which can be mass produced, has a minimal number of parts, which is limited in size and can be very easily used.

It is still another object of the present invention to provide an electric switch as described above that ensures proper gravity tip function regardless of deflection of the temperature responsive portions of the switch.

Accordingly, in one embodiment of the present invention, there is provided a temperature sensitive tip switch comprising a first conductive arm having a first end and a second end, a second conductive arm disposed in a parallel, spaced apart relation beneath said first conductive arm, said second conductive arm having a first end, a second end and a central cut-out portion capable of flexion in a downward direction away from said first conductive arm, a third conductive arm disposed in a parallel relation beneath said second conductive arm, said third conductive arm having a first end, a second end and a central cut-out portion capable of flexion in a downward direction away from said second conductive arm, the central cut-out portion in said third conductive arm being engaged with the central cut-out portion formed in said second conductive arm, the second end of said third conductive arm being affixed to the second end of said second conductive arm, a temperature sensitive actuator blade disposed in a parallel, spaced apart relation beneath said third conductive arm, said temperature sensitive actuator blade having a first end and a second end, a first pair of normally closed, electrical contacts, one of said first pair of electrical contacts being mounted on said temperature sensitive actuator blade and the other of said first pair of electrical contacts being mounted on said third conductive arm, a second pair of normally closed, electrical contacts, one of said second pair of electrical contacts being mounted on said second conductive arm and the other of said second pair of electrical contacts being mounted on said first conductive arm, an adjustable thermostat shaft assembly disposed to contact and selectively urge the cut-out portion in said second conductive arm in a downward direction towards said third conductive arm so as to open said first pair of electrical contacts, an insulated button mounted on said actuator blade, said insulated button being disposed to contact and selectively urge said third conductive arm towards said first conductive arm so as to open said first pair of electrical contacts, and a tip-over device mounted on said actuator blade, said tip-over device being disposed to selectively urge said first conductive arm away from said second conductive arm so as to open said second pair of electrical contacts.

In other embodiments of the present invention, there is provided a temperature sensitive tip switch comprising a first conductive arm having a first end and a second end, a second conductive arm disposed in a parallel, spaced apart relation beneath said first conductive arm, said second conductive arm having a first end, a second end and a central cut-out portion capable of flexion in a downward direction away from said first conductive arm, a third conductive arm disposed in a parallel relation beneath said second conductive arm, said third conductive arm having a first end, a second end and a central cut-out portion capable of flexion in a downward direction away from said second conductive arm, the central cut-out portion in said third conductive arm being engaged with the central cut-out portion formed in said second conductive arm, the second end of said third conductive arm being affixed to the second end of said second conductive arm, a fourth conductive arm disposed in a parallel, spaced apart relation beneath said third conductive arm, a temperature sensitive actuator blade disposed in a parallel relation beneath said fourth conductive arm, said temperature sensitive actuator blade having a first end and a second end, a first pair of normally closed, electrical contacts, one of said first pair of electrical contacts being mounted on said fourth conductive arm and the other of said first pair of electrical contacts being mounted on said third conductive arm, a second pair of normally closed, electrical contacts, one of said second pair of electrical contacts being mounted on said second conductive arm and the other of said second pair of electrical contacts being mounted on said first conductive arm, an adjustable thermostat shaft assembly disposed to contact and selectively urge the cut-out portion in said second conductive arm in a downward direction towards said third conductive arm so as to open said first pair of electrical contacts, an insulated button mounted on said actuator blade, said insulated button being disposed to contact and selectively urge said third conductive arm towards said first conductive arm so as to open said first pair of electrical contacts, and a tip-over device mounted on said actuator blade, said tip-over device being disposed to selectively urge said first conductive arm away from said second conductive arm so as to open said second pair of electrical contacts.

In another embodiment of the present invention, there is provided a temperature sensitive tip switch comprising a first conductive arm having a first end and a second end, a second conductive arm disposed in a parallel, spaced apart relation beneath said first conductive arm, said second conductive arm having a first end, a second end and a central cut-out portion capable of flexion in a downward direction away from said first conductive arm, a third conductive arm disposed in a parallel relation beneath said second conductive arm, said third conductive arm having a first end, a second end and a central cut-out portion capable of flexion in a downward direction away from said second conductive arm, the central cut-out portion in said third conductive arm being engaged with the central cut-out portion formed in said second conductive arm, the second end of said third conductive arm being affixed to the second end of said second conductive arm, a carrier blade disposed in a parallel, spaced apart relation beneath said third conductive arm, a temperature sensitive actuator blade disposed in a parallel, spaced apart relation beneath said carrier blade, said temperature sensitive actuator blade having a first end and a second end, a first pair of normally closed, electrical contacts, one of said first pair of electrical contacts being mounted on said carrier blade and the other of said first pair of electrical contacts being mounted on said third conductive arm, a second pair of normally closed, electrical contacts, one of said second pair of electrical contacts being mounted on said second conductive arm and the other of said second pair of electrical contacts being mounted on said first conductive arm, an adjustable thermostat shaft assembly disposed to contact and selectively urge the cut-out portion in said second conductive arm in a downward direction towards said third conductive arm so as to open said first pair of electrical contacts, an insulated button mounted on said actuator blade, said insulated button being disposed to contact and selectively urge said third conductive arm towards said first conductive arm so as to open said first pair of electrical contacts, and a tip-over device mounted on said carrier blade, said tip-over device being disposed to selectively urge said first conductive arm away from said second conductive arm so as to open said second pair of electrical contacts.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration particular embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate particular embodiments of the invention and, together with the description, serve to explain the principles of the invention. In the drawings wherein like reference numerals represent like parts.

DETAILED DESCRIPTION OF A PREFERRED EMBODIMENT

Figure 1:
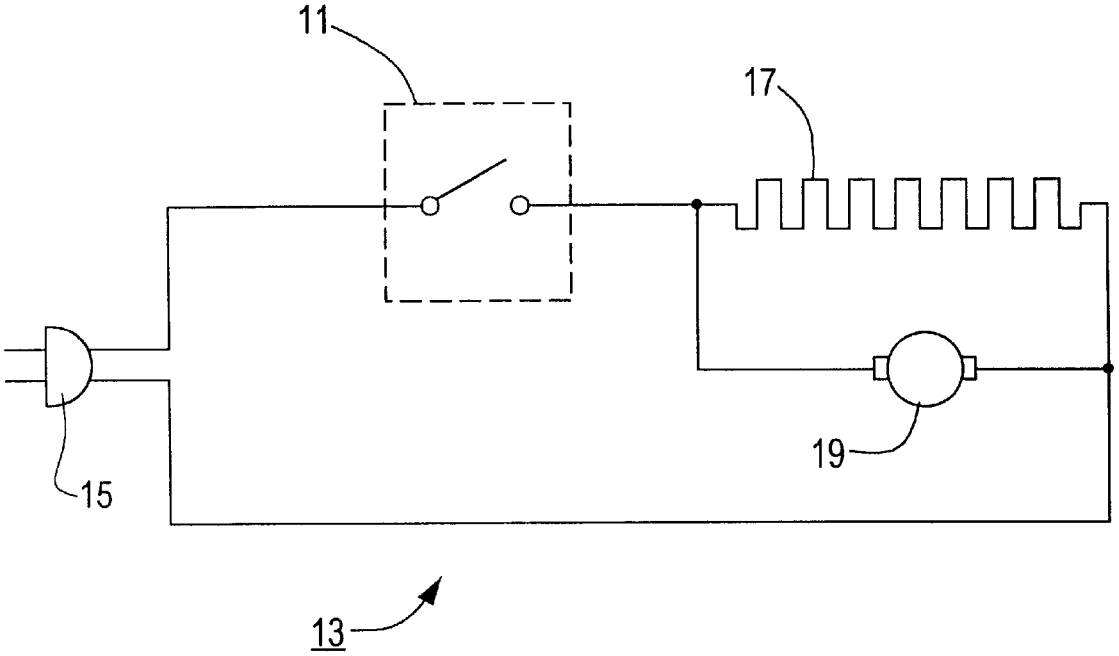
FIG. 1 is a schematic electrical diagram illustrating the functions of a first embodiment of a temperature sensitive tip-switch constructed according to the teachings of the present invention.

Referring now to the drawings, there is shown a temperature sensitive tip-switch constructed according to the teachings of the present invention, the temperature sensitive tip-switch being represented generally by reference numeral 11. As will be described further in detail below, switch 11 can be used in an electrical circuit which requires power interruption.

In FIG. 1, switch 11 is shown being used in an electrical circuit 13 for an appliance, such as an electric heater, which requires interruption of power. Specifically, electrical circuit 13 comprises a voltage source 15, such as a standard electrical outlet, and a heater element 17 which are connected in series with switch 11. A fan blower 19 is connected in parallel with heater element 17. As will be described further in detail below, switch 11 provides temperature, gravity and manually provided snap-action, or fast-action, responsive interruption for circuit 13.

Figure 4:
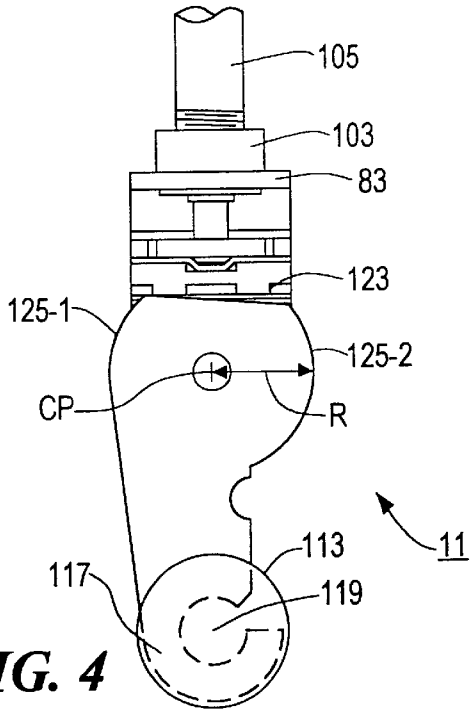
FIG. 4 is a right side view of the temperature sensitive tip-switch shown in FIG. 1.
Figure 3:
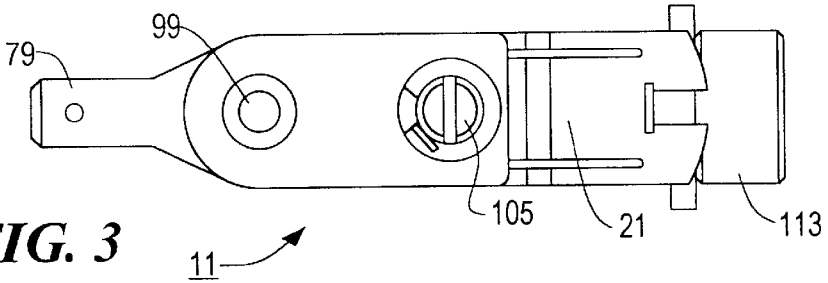
FIG. 3 is a top plan view of the temperature sensitive tip-switch shown in FIG. 1.
Figure 2:
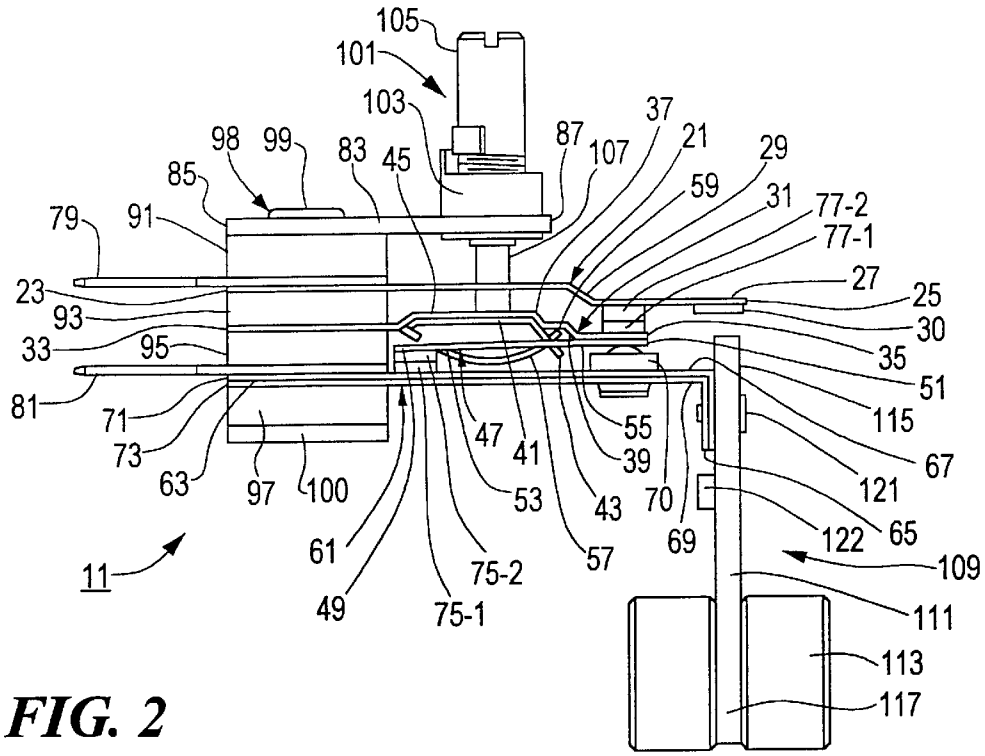
FIG. 2 is a front view of the temperature sensitive tip-switch shown in FIG. 1, the switch being shown in its closed position.

Referring now to FIGS. 2–4, switch 11 comprises a first conductive arm 21 having a first end 23, a second end 25, a top surface 27 and a bottom surface 29. First conductive arm 21 is constructed of a flexible, conductive material and includes a central, circular opening (not shown) formed therein and a contact pad 30 affixed to bottom surface 29 at second end 25. However, it should be noted that contact pad 30 could alternatively be removed from first conductive arm 21 without limiting the functionality of switch 11 and without departing from the spirit of the present invention.

A second conductive arm 31 is disposed in a parallel, spaced apart relation beneath first conductive arm 21. Second conductive arm 31 comprises a first end 33, a second end 35, a top surface 37 and a bottom surface 39. Second conductive arm 31 is constructed of a flexible, generally rectangular, conductive material and includes an elongated, central cut-out portion 41 formed therein. Cut-out portion 41 is shaped to permit downward, resilient, flexion and includes a free end 43 having a slot (not shown) formed therein. Cut-out portion 41 additionally comprises a tab 45 cut out thereof, tab 45 being disposed to project in a downward direction.

A third conductive arm 47 is disposed in a parallel relation beneath second conductive arm 31. Third conductive arm 47 comprises a first end 49, a second end 51, a top surface 53 and a bottom surface 55. Top surface 53 of third conductive arm 47 at second end 51 is affixed to bottom surface 39 of second conductive arm 31 at second end 35 to electrically couple third conductive arm 47 to second conductive arm 31, with first end 49 of third conductive arm 47 disposed beneath tab 45 in a slightly spaced-apart relation. Third conductive arm 47 is constructed of a flexible, generally rectangular, conductive material and includes an elongated, central cut-out portion 57 formed therein. Cut-out portion 57 includes a free end 59 which is sized and shaped to protrude through the slot formed in cut-out portion 41 and thereby engage second conductive arm 31.

A bi-metal actuator blade 61 is disposed in a parallel, spaced apart relation beneath third conductive arm 47. Actuator blade 61 is generally L-shaped as shown in FIG. 2, but it is to be understood that actuator blade 61 may be constructed in alternate configurations without departing from the spirit of the present invention. Actuator blade 61 comprises a first end 63, a second end 65, a top surface 67 and a bottom surface 69. An insulated button 70, preferably constructed of a ceramic material, is mounted on top surface 67 of actuator blade 61 proximate second end 65 and is disposed so as to directly contact bottom surface 55 of third conductive arm 47 at second end 51. Actuator blade 61 is constructed of a layer of low expansion metal 71 and a layer of high expansion metal 73 which are clad together to make blade 61 a unitary member. As will be described further in detail below, the difference in the coefficient of expansion of layers 71 and 73 causes actuator blade 61 to bend upon the presence of heat.

A first pair of conventional electrical contacts 75-1 and 75-2 are mounted on top surface 67 of bi-metal actuator blade 61 and bottom surface 55 of third conductive arm 47 at first end 49, respectively. Contacts 75 are disposed in a normally closed position, as shown in FIG. 2, and serve to electrically connect actuator blade 61 to third conductive arm 47.

A second pair of conventional electrical contacts 77-1 and 77-2 are mounted on top surface 37 of second conductive arm 31 at second end 35 and bottom surface 29 of first conductive arm 21 proximate second end 25, respectively. Contacts 77 are disposed in a normally closed position, as shown in FIG. 2, and serve to electrically connect second conductive arm 31 to first conductive arm 21.

A first contact prong 79 is mounted flat on top surface 27 of first conductive arm 21 at first end 23 so as to electrically connect prong 79 to first conductive arm 21. Similarly, a second contact prong 81 is mounted flat on top surface 67 of actuator blade 61 at first end 63 so as to electrically connect prong 81 to actuator blade 61. Together, contact prongs 79 and 81 serve to enable switch 11 to be easily connected to electrical circuit 13.

A generally rectangularly shaped mounting plate 83 is disposed in a parallel, spaced apart relation above first contact prong 79. Mounting plate 83 is constructed of a rigid, non-flexible material and comprises a first end 85, a second end 87 and a central opening (not shown) formed therein at second end 87.

A first insulated layer 91, preferably constructed of a ceramic material, is disposed between mounting plate 83 and prong 79 and serves to prevent the establishment of an electric current therebetween. A second insulated layer 93, preferably constructed of a ceramic material, is disposed between first conductive arm 21 and second conductive arm 31 and serves to prevent the establishment of an electric current therebetween. A third insulated layer 95, preferably constructed of a ceramic material, is disposed between second conductive arm 31 and prong 81 and serves to prevent the establishment of an electric current therebetween. A fourth insulated layer 97, preferably constructed of a ceramic material, is disposed beneath actuator blade 61.

A rivet 98 serves to help maintain the configuration of switch 11. Rivet 98 comprises a shaft 99, which is punched through mounting plate 83, first insulated layer 91, prong 79, first conductive arm 21, second insulated layer 93, second conductive arm 31, third insulated layer 95, prong 81, actuator blade 61 and fourth insulated layer 97, and a head 100 which is disposed beneath fourth insulated layer 97.

Switch 11 additionally comprises an adjustable thermostat shaft assembly 101 for providing both manual snap-action and temperature responsive interruption for circuit 13, as will be described further in detail below. Adjustable thermostat shaft assembly 101 comprises an internally threaded, cylindrical bushing 103 which is fixedly disposed within the opening formed in mounting plate 83, a threaded screw shaft 105 which is rotably disposed within bushing 103 and a pin 107 which is fixedly connected to screw shaft 105. Pin 107, which is constructed of an insulative material such as ceramic, is disposed to pass through the opening (not shown) formed in first conductive plate 21 and directly contact cut-out portion 41 in second conductive arm 21. It should be noted that rotation of shaft 105 in a counterclockwise direction serves to move pin 107 in a downward direction which, in turn, displaces cut-out portion 41 in a downward direction. Similarly, rotation of shaft 105 in a clockwise direction serves to move pin 107 in an upward direction which, in turn, displaces cut-out portion 41 in an upward direction.

Switch 11 further comprises a tip-over, or pendulum, device 109 for providing uni-planar gravity responsive interruption for circuit 13, as will be described further in detail below. Tip-over device 109 comprises a pendulum arm 111 pivotally mounted on actuator blade 61 and a cylindrical weight 113 mounted on pendulum arm 111. Pendulum arm 111 is constructed of an insulative material, such as nylon, and comprises a first end 115 and a generally C-shaped second end 117 which is shaped to define an arcuate recess 119 therewithin in which cylindrical weight 113 is fixedly disposed. First end 115 of pendulum arm 111 is pivotally affixed to second end 65 of actuator blade 61 by a rivet 121. A stop 122 is integrally formed on pendulum arm 111 between first end 115 and second end 117 and serves to limit rotation of pendulum arm 111 relative to actuator blade 61.

First end 115 of pendulum arm 111 is generally circular in shape and comprises a center point CP and a flat top edge portion 123 which is disposed between a pair of arcuate side edge portions 125-1 and 125-2, as shown in FIG. 4. It should be noted that arcuate side edge portions 125-1 and 125-2 have a constant radial distance R. To the contrary, the distance between flat top edge portion 123 and center point CP is less than constant radial distance R.

In use, switch 11 functions in the following manner. In FIGS. 2–4, switch 11 is shown in its normally closed position. Specifically, with switch 11 in its normally closed position, contacts 75 and 77 are closed, thereby enabling current to pass from prong 79 to prong 81.

Figure 5:
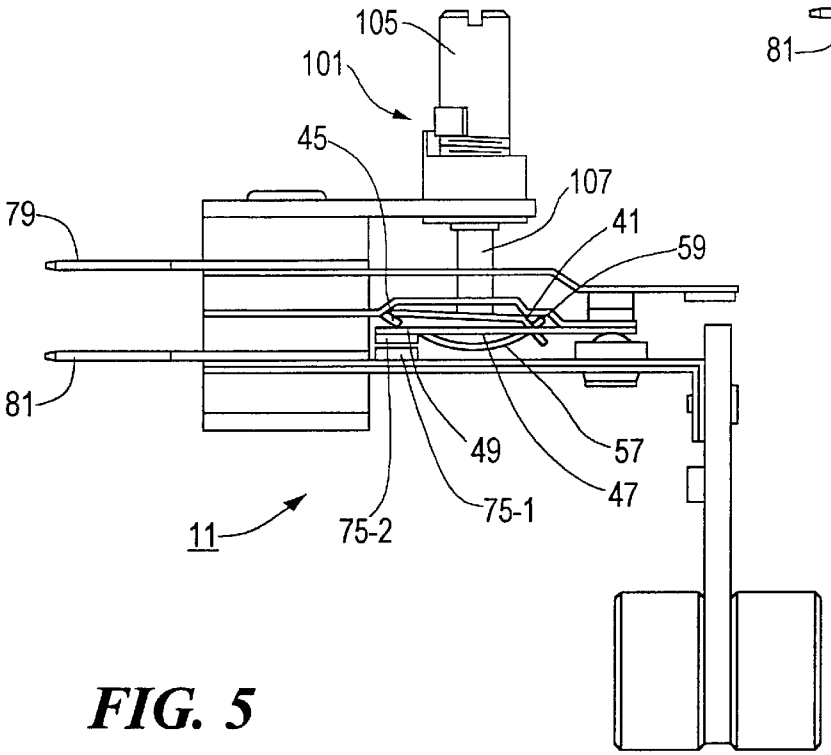
FIG. 5 is a front view of the temperature sensitive tip-switch shown in FIG. 1, the switch being shown with the adjustable thermostat shaft assembly opening the first pair of conventional electrical contacts.

Significant counterclockwise rotation of shaft 105 of adjustable thermostat shaft assembly 101 provides snap-action, or fast-action, responsive interruption for switch 11. Specifically, counterclockwise rotation of shaft 105 serves to move pin 107 in a downward direction onto cut-out portion 41. Downward displacement of cut-out portion 41, in turn, serves to move free end 59 of cut-out portion 57 in a downward direction. Significant downward movement of free end 59 causes cut-out portion 57 to bow which, in turn, causes first end 49 of third conductive arm 47 to quickly snap-act in an upward direction and abut against tab 45. Upward movement of first end 49 of third conductive arm 47 opens contacts 75, as shown in FIG. 5, which consequently prevents current from passing from prong 79 to prong 81, thereby opening switch 11.

Figure 6:
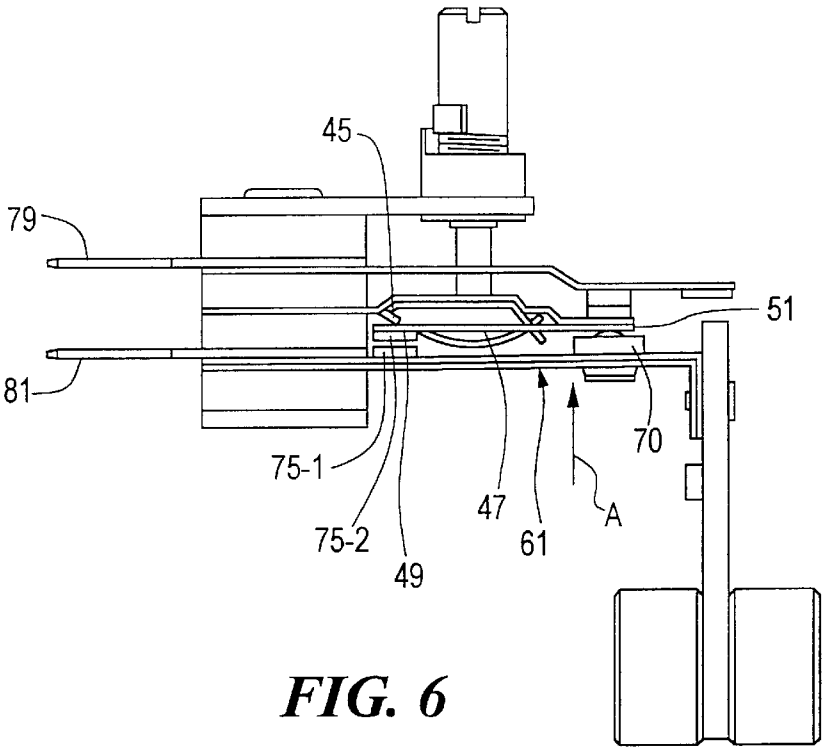
FIG. 6 is a front view of the temperature sensitive tip-switch shown in FIG. 1, the switch being shown with the bi-metal actuator blade opening the first pair of conventional electrical contacts.

In addition, significant application of heat on bi-metal actuator blade 61 provides temperature responsive interruption for switch 11. Specifically, if there is excessive heat applied to switch 11, actuator blade 61, because it is temperature responsive and of bi-metal construction, will be slowly bent in an upward direction, as represented by arrow A in FIG. 6. As actuator blade 61 is bent in an upward direction, insulated button 70 on actuator blade 61, in turn, urges second end 51 of third conductive arm 47 in an upward direction. Upward movement of second end 51 of third conductive arm 47, in turn, causes first end 49 of third conductive arm 47 to move in an upward direction and abut against tab 45. Significant upward movement of first end 49 of third conductive arm 47 quickly snaps open contacts 75 which, in turn, prevents current from passing from prong 79 to prong 81, thereby opening switch 11.

Figure 7:
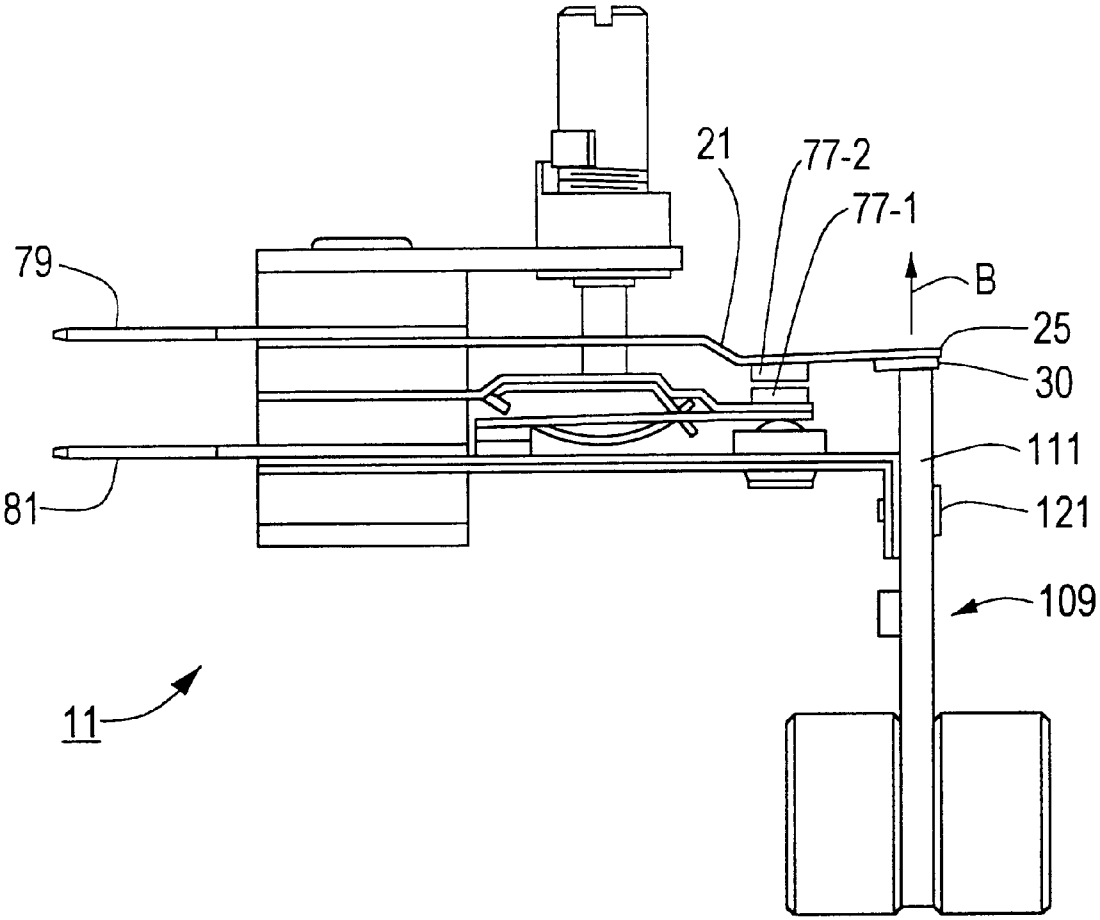
FIG. 7 is a front view of the temperature sensitive tip-switch shown in FIG. 1, the switch being shown with the tip-over device opening the second pair of conventional electrical contacts.

Furthermore, the introduction of a change in orientation of tip-over device 109 provides uni-planar gravity interruption for switch 11. Specifically, with switch 11 orientated in its normal position, as shown in FIGS. 2–4, flat top edge portion 123 of pendulum arm 111 is disposed directly beneath and spaced apart from contact pad 30. If switch 11 is tipped forward or backward, pendulum arm 111 will pivot about rivet 121. The pivoting of pendulum arm 111 rotates either arcuate side edge portion 125-1 or arcuate side edge portion 125-2 directly beneath contact pad 30. Because the side edge portions 125 have a constant radial distance R which is greater than the distance between flat top edge portion 123 and center point CP, as arcuate side edge portions 125 are disposed beneath contact pad 30, first end 115 of pendulum arm 111 abuts against contact pad 30 and urges second end 25 of first conductive arm 21 in an upward direction, as represented by arrow B in FIG. 7. Upward movement of second end 25 of first conductive arm 21 opens contacts 77 which, in turn, prevents current from passing from prong 79 to prong 81, thereby opening switch 11.

It should be noted that because pendulum arm 111 is mounted on actuator blade 61, tip-over device 109 is spaced a constant distance away from first conductive arm 21 regardless of whether actuator blade 61 is bent in response to an increase in ambient air temperature. Specifically, because pendulum arm 111 is mounted on actuator blade 61, upward bending of actuator blade 61 in response to increases in ambient air temperature, in turn, causes pendulum arm 111 to be displaced upward. Furthermore, as actuator blade 61 is bent upward in response to increases in ambient air temperature, insulated button 70 urges third conductive arm 47 and, in turn, first conductive arm 21 in an upward direction, thereby maintaining the constant distance between pendulum arm 111 of tip-over device 109 and first conductive arm 21. Maintaining the constant distance between pendulum arm 111 and first conductive arm 21 ensures proper operation of tip-over device 109 regardless of the amount of curvature and upward movement of actuator blade 61, which is highly desirable.

Figure 10:
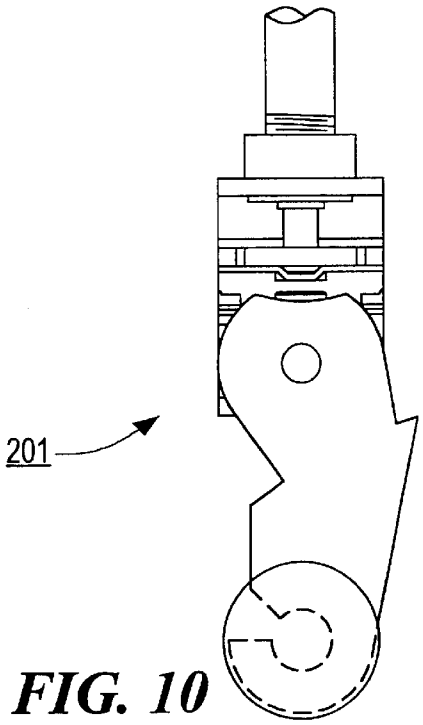
FIG. 10 is a right side view of the temperature sensitive tip-switch shown in FIG. 8.
Figure 9:
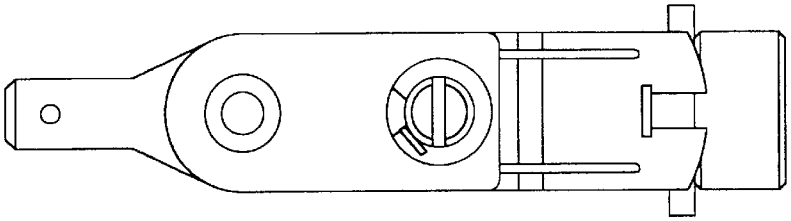
FIG. 9 is a top plan view of the temperature sensitive tip-switch shown in FIG. 8.
Figure 8:
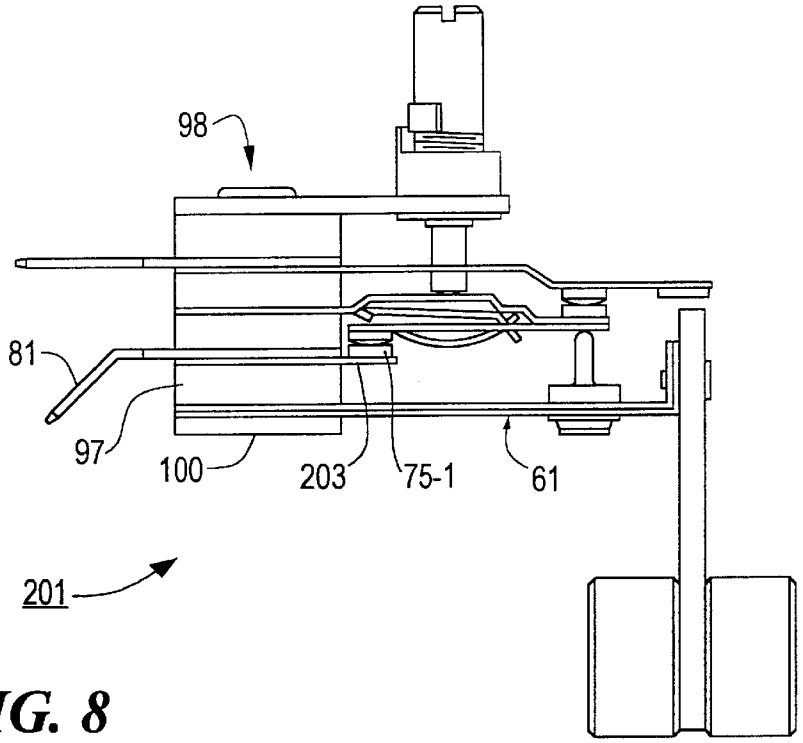
FIG. 8 is a front view of a second embodiment of a temperature sensitive tip-switch constructed according to the teachings of the present invention.

Referring now to FIGS. 8–10, there is shown a second embodiment of a switch constructed according to the teachings of the present invention, the switch being identified as reference numeral 201.

The principle distinction between switch 201 and switch 11 is that switch 201 comprises a fourth conductive arm 203 on which conventional contact 75-1 is disposed. Fourth conductive arm 203 is disposed between prong 81 and fourth insulated layer 97 and actuator blade 61 is relocated between fourth insulated layer 97 and head 100 of rivet 98.

It should be noted that separating actuator blade 61 from prong 81 and contact 75-1 in switch 201 serves to electrically isolate actuator blade 61. In contrast, in switch 11, actuator blade 61 is in contact with prong 81 and contact 75-1.

Figure 13:
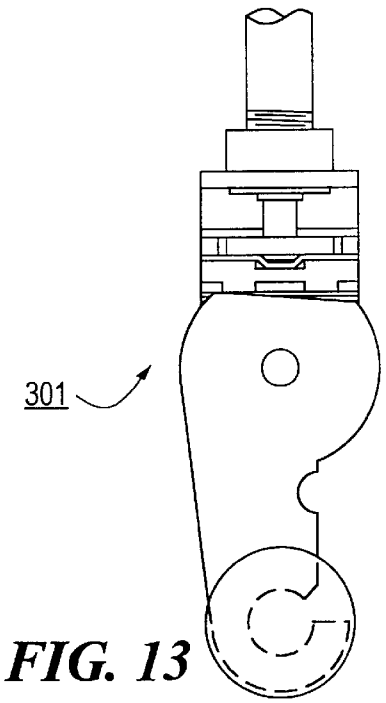
FIG. 13 is a right side view of the temperature sensitive tip-switch shown in FIG. 11.
Figure 12:
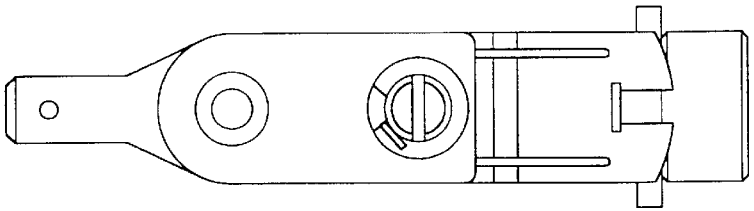
FIG. 12 is a top plan view of the temperature sensitive tip-switch shown in FIG. 11.
Figure 11:
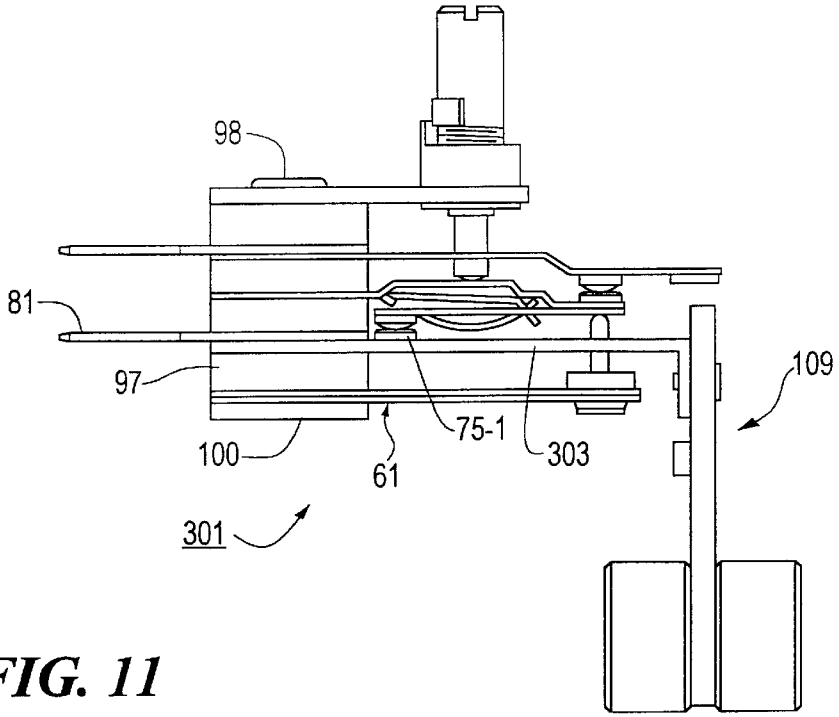
FIG. 11 is a front view of a third embodiment of a temperature sensitive tip-switch constructed according to the teachings of the present invention.

Referring now to FIGS. 11–13, there is shown a third embodiment of a switch constructed according to the teachings of the present invention, the switch being identified as reference numeral 301.

The principle distinction between switch 301 and switch 11 is that switch 301 comprises an independent carrier blade 303 on which conventional contact 75-1 and tip-over device 109 are mounted. Independent carrier blade 303 is disposed between prong 81 and fourth insulated layer 97 and actuator blade 61 is relocated between fourth insulated layer and head 100 of rivet 98.

It should be noted that separating actuator blade 61 from prong 81 and contact 75-1 in switch 301 serves to electrically isolate actuator blade 61. In contrast, in switch 11, actuator blade 61 is in contact with prong 81 and contact 75-1.

Figure 16:
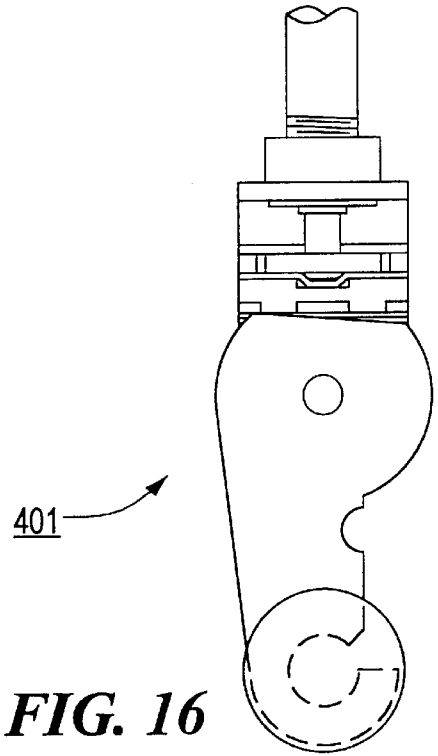
FIG. 16 is a right side view of the temperature sensitive tip-switch shown in FIG. 14.
Figure 15:
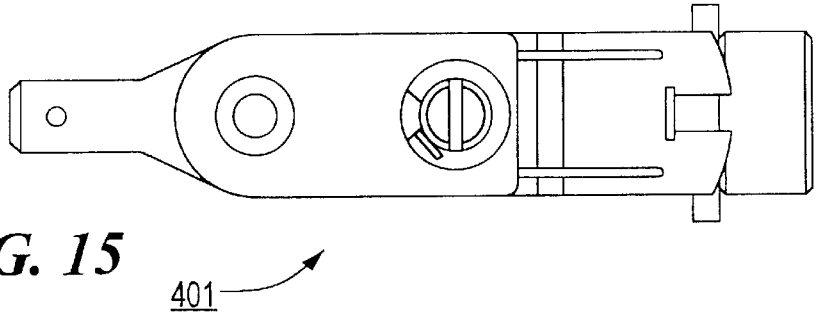
FIG. 15 is a top plan view of the temperature sensitive tip-switch shown in FIG. 14.
Figure 14:
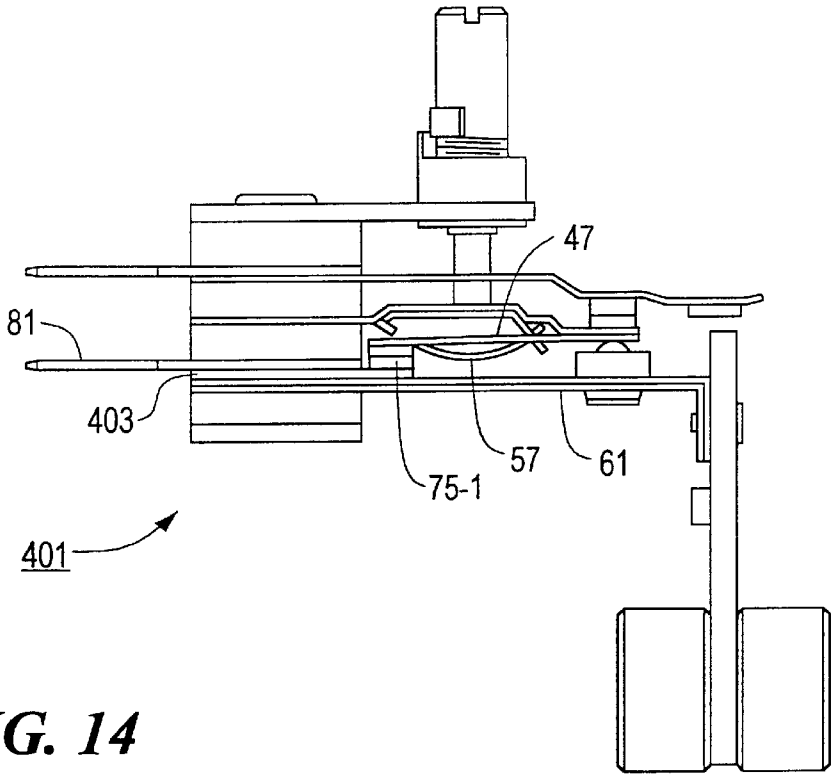
FIG. 14 is a front view of a fourth embodiment of a temperature sensitive tip-switch constructed according to the teachings of the present invention.

Referring now to FIGS. 14–16, there is shown a fourth embodiment of a switch constructed according to the teachings of the present invention, the switch being identified as reference numeral 401.

The principle distinction between switch 401 and switch 11 is that switch 401 comprises a fourth conductive arm 403 on which conventional contact 75-1 is disposed. Fourth conductive arm 403 is disposed between prong 81 and actuator blade 61.

It should be noted that disposing fourth conductive arm 403 between prong 81 and actuator blade 61 serves to increase the through air spacings between cut-out portion 57 in third conductive arm 47 and actuator blade 61.

It should also be noted that actuator blade 61 in switch 401 is electrically live but is not considered a current carrying part. As a consequence, actuator blade 61 will bend in response to changes in ambient air temperature only and will not be effected by any internal heating caused by electrical current passing through actuator blade 61.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A temperature sensitive tip switch comprising:

a. a first conductive arm having a first end and a second end;

b. a second conductive arm disposed in a parallel, spaced apart relation beneath said first conductive arm, said second conductive arm having a first end, a second end and a central cut-out portion capable of flexion in a downward direction away from said first conductive arm;

c. a third conductive arm disposed in a parallel relation beneath said second conductive arm, said third conductive arm having a first end, a second end and a central cut-out portion capable of flexion in a downward direction away from said second conductive arm, the central cut-out portion in said third conductive arm being engaged with the central cut-out portion formed in said second conductive arm, the second end of said third conductive arm being affixed to the second end of said second conductive arm;

d. a temperature sensitive actuator blade disposed in a parallel, spaced apart relation beneath said third conductive arm, said temperature sensitive actuator blade having a first end and a second end;

e. a first pair of normally closed, electrical contacts, one of said first pair of electrical contacts being mounted on said temperature sensitive actuator blade and the other of said first pair of electrical contacts being mounted on said third conductive arm;

f. a second pair of normally closed, electrical contacts, one of said second pair of electrical contacts being mounted on said second conductive arm and the other of said second pair of electrical contacts being mounted on said first conductive arm;

g. an adjustable thermostat shaft assembly disposed to contact and selectively urge the cut-out portion in said second conductive arm in a downward direction towards said third conductive arm so as to open said first pair of electrical contacts;

h. an insulated button mounted on said actuator blade, said insulated button being disposed to contact and selectively urge said third conductive arm towards said first conductive arm so as to open said first pair of electrical contacts; and i. a tip-over device mounted on said actuator blade, said tip-over device being disposed to selectively urge said first conductive arm away from said second conductive arm so as to open said second pair of electrical contacts.

2. The temperature sensitive tip switch of claim 1 wherein said tip-over device comprises a pendulum arm pivotally mounted on said actuator blade and a weight mounted on said pendulum arm, said pendulum arm having a first end and a second end.

3. The temperature sensitive tip switch of claim 2 wherein the first end of said pendulum arm comprises a center point, and a top edge portion which is disposed between a pair of arcuate side edge portions, said pair of arcuate side edge portions having a constant radial distance which is greater than the distance between the top edge portion and the center point.

4. The temperature sensitive tip switch of claim 3 further comprising a mounting plate disposed in a parallel, spaced apart relation above said first conductive arm.

5. The temperature sensitive tip switch of claim 4 wherein said adjustable thermostat shaft assembly comprises an internally threaded bushing fixedly disposed in the mounting plate, a threaded screw shaft rotably disposed within the bushing and a pin fixedly connected to the screw shaft, the pin being disposed to contact the cut-out portion in said second conductive arm.

6. The temperature sensitive tip switch of claim 5 further comprising a first insulated layer disposed between the mounting plate and said first conductive arm, a second insulated layer disposed between said first conductive arm and said second conductive arm, a third insulated layer disposed between said second conductive arm and said actuator blade and a fourth insulated layer disposed beneath said actuator blade.

7. The temperature sensitive tip switch of claim 6 wherein said actuator blade comprises a layer of high expansion metal and a layer of low expansion metal.

8. The temperature sensitive tip switch of claim 7 further comprising first and second contact prongs, said first contact prong being mounted on said first conductive arm and said second contact prong being mounted on said actuator blade.

9. A temperature sensitive tip switch comprising:

a. a first conductive arm having a first end and a second end;

b. a second conductive arm disposed in a parallel, spaced apart relation beneath said first conductive arm, said second conductive arm having a first end, a second end and a central cut-out portion capable of flexion in a downward direction away from said first conductive arm;

c. a third conductive arm disposed in a parallel relation beneath said second conductive arm, said third conductive arm having a first end, a second end and a central cut-out portion capable of flexion in a downward direction away from said second conductive arm, the central cut-out portion in said third conductive arm being engaged with the central cut-out portion formed in said second conductive arm, the second end of said third conductive arm being affixed to the second end of said second conductive arm;

d. a fourth conductive arm disposed in a parallel, spaced apart relation beneath said third conductive arm;

e. a temperature sensitive actuator blade disposed in a parallel relation beneath said fourth conductive arm, said temperature sensitive actuator blade having a first end and a second end;

f. a first pair of normally closed, electrical contacts, one of said first pair of electrical contacts being mounted on said fourth conductive arm and the other of said first pair of electrical contacts being mounted on said third conductive arm;

g. a second pair of normally closed, electrical contacts, one of said second pair of electrical contacts being mounted on said second conductive arm and the other of said second pair of electrical contacts being mounted on said first conductive arm;

h. an adjustable thermostat shaft assembly disposed to contact and selectively urge the cut-out portion in said second conductive arm in a downward direction towards said third conductive arm so as to open said first pair of electrical contacts;

i. an insulated button mounted on said actuator blade, said insulated button being disposed to contact and selectively urge said third conductive arm towards said first conductive arm so as to open said first pair of electrical contacts; and j. a tip-over device mounted on said actuator blade, said tip-over device being disposed to selectively urge said first conductive arm away from said second conductive arm so as to open said second pair of electrical contacts.

10. The temperature sensitive tip switch of claim 9 wherein said tip-over device comprises a pendulum arm pivotally mounted on said actuator blade and a weight mounted on said pendulum arm, said pendulum arm having a first end and a second end.

11. The temperature sensitive tip switch of claim 10 further comprising a mounting plate disposed in a parallel, spaced apart relation above said first conductive arm.

12. The temperature sensitive tip switch of claim 10 wherein said adjustable thermostat shaft assembly comprises an internally threaded bushing fixedly disposed in the mounting plate, a threaded screw shaft rotably disposed within the bushing and a pin fixedly connected to the screw shaft, the pin being disposed to contact the cut-out portion in said second conductive arm.

13. The temperature sensitive tip switch of claim 12 further comprising a first insulated layer disposed between the mounting plate and said first conductive arm, a second insulated layer disposed between said first conductive arm and said second conductive arm, a third insulated layer disposed between said second conductive arm and said fourth conductive arm and a fourth insulated layer disposed between said fourth conductive arm and said actuator blade.

14. The temperature sensitive tip switch of claim 12 further comprising a first insulated layer disposed between the mounting plate and said first conductive arm, a second insulated layer disposed between said first conductive arm and said second conductive arm, a third insulated layer disposed between said second conductive arm and said fourth conductive arm and a fourth insulated layer disposed beneath said actuator blade.

15. A temperature sensitive tip switch comprising:

a. a first conductive arm having a first end and a second end;

b. a second conductive arm disposed in a parallel, spaced apart relation beneath said first conductive arm, said second conductive arm having a first end, a second end and a central cut-out portion capable of flexion in a downward direction away from said first conductive arm;

c. a third conductive arm disposed in a parallel relation beneath said second conductive arm, said third conductive arm having a first end, a second end and a central cut-out portion capable of flexion in a downward direction away from said second conductive arm, the central cut-out portion in said third conductive arm being engaged with the central cut-out portion formed in said second conductive arm, the second end of said third conductive arm being affixed to the second end of said second conductive arm;

d. a carrier blade disposed in a parallel, spaced apart relation beneath said third conductive arm, e. a temperature sensitive actuator blade disposed in a parallel, spaced apart relation beneath said carrier blade, said temperature sensitive actuator blade having a first end and a second end;

f. a first pair of normally closed, electrical contacts, one of said first pair of electrical contacts being mounted on said carrier blade and the other of said first pair of electrical contacts being mounted on said third conductive arm;

g. a second pair of normally closed, electrical contacts, one of said second pair of electrical contacts being mounted on said second conductive arm and the other of said second pair of electrical contacts being mounted on said first conductive arm;

h. an adjustable thermostat shaft assembly disposed to contact and selectively urge the cut-out portion in said second conductive arm in a downward direction towards said third conductive arm so as to open said first pair of electrical contacts;

i. an insulated button mounted on said actuator blade, said insulated button being disposed to contact and selectively urge said third conductive arm towards said first conductive arm so as to open said first pair of electrical contacts; and i. a tip-over device mounted on said carrier blade, said tip-over device being disposed to selectively urge said first conductive arm away from said second conductive arm so as to open said second pair of electrical contacts.

16. The temperature sensitive tip switch of claim 15 wherein said tip-over device comprises a pendulum arm pivotally mounted on said carrier blade and a weight mounted on said pendulum arm, said pendulum arm having a first end and a second end.

17. The temperature sensitive tip switch of claim 16 wherein the first end of said pendulum arm comprises a center point, and a top edge portion which is disposed between a pair of arcuate side edge portions, said pair of arcuate side edge portions having a constant radial distance which is greater than the distance between the top edge portion and the center point.

18. The temperature sensitive tip switch of claim 17 further comprising a mounting plate disposed in a parallel, spaced apart relation above said first conductive arm.

19. The temperature sensitive tip switch of claim 18 wherein said adjustable thermostat shaft assembly comprises an internally threaded bushing fixedly disposed in the mounting plate, a threaded screw shaft rotably disposed within the bushing and a pin fixedly connected to the screw shaft, the pin being disposed to contact the cut-out portion in said second conductive arm.

20. The temperature sensitive tip switch of claim 19 further comprising a first insulated layer disposed between the mounting plate and said first conductive arm, a second insulated layer disposed between said first conductive arm and said second conductive arm, a third insulated layer disposed between said second conductive arm and said carrier blade and a fourth insulated layer disposed between said carrier blade and said actuator blade.

21. A temperature sensitive tip switch comprising:

a. a first conductive arm having a first end and a second end;

b. a second conductive arm disposed in a parallel, spaced apart relation beneath said first conductive arm, said second conductive arm having a first end, a second end and a central cut-out portion capable of flexion in a downward direction away from said first conductive arm;

c. a third conductive arm disposed in a parallel relation beneath said second conductive arm, said third conductive arm having a first end, a second end and a central cut-out portion capable of flexion in a downward direction away from said second conductive arm, the central cut-out portion in said third conductive arm being engaged with the central cut-out portion formed in said second conductive arm, the second end of said third conductive arm being affixed to the second end of said second conductive arm;

d. a fourth conductive arm disposed in a parallel, spaced apart relation beneath said third conductive arm;

e. a temperature sensitive actuator blade disposed in a parallel, spaced apart relation beneath said fourth conductive arm, said temperature sensitive actuator blade having a first end and a second end;

f. a first pair of normally closed, electrical contacts, one of said first pair of electrical contacts being mounted on said fourth conductive arm and the other of said first pair of electrical contacts being mounted on said third conductive arm;

g. a second pair of normally closed, electrical contacts, one of said second pair of electrical contacts being mounted on said second conductive arm and the other of said second pair of electrical contacts being mounted on said first conductive arm;

h. an adjustable thermostat shaft assembly disposed to contact and selectively urge the cut-out portion in said second conductive arm in a downward direction towards said third conductive arm so as to open said first pair of electrical contacts;

i. an insulated button mounted on said actuator blade, said insulated button being disposed to contact and selectively urge said third conductive arm towards said first conductive arm so as to open said first pair of electrical contacts; and j. a tip-over device mounted on said actuator blade, said tip-over device being disposed to selectively urge said first conductive arm away from said second conductive arm so as to open said second pair of electrical contacts.

22. A temperature sensitive tip switch comprising:

a. a first conductive arm having a first end and a second end;

b. a second conductive arm disposed in a parallel, spaced apart relation beneath said first conductive arm, said second conductive arm having a first end, a second end and a central cut-out portion capable of flexion in a downward direction away from said first conductive arm;

c. a third conductive arm disposed in a parallel relation beneath said second conductive arm, said third conductive arm having a first end, a second end and a central cut-out portion capable of flexion in a downward direction away from said second conductive arm, the central cut-out portion in said third conductive arm being engaged with the central cut-out portion formed in said second conductive arm, the second end of said third conductive arm being affixed to the second end of said second conductive arm;

d. a fourth conductive arm disposed in a parallel, spaced apart relation beneath said third conductive arm;

e. a temperature sensitive actuator blade disposed beneath and in contact with said fourth conductive arm, said temperature sensitive actuator blade having a first end and a second end;

f. a first pair of normally closed, electrical contacts, one of said first pair of electrical contacts being mounted on said fourth conductive arm and the other of said first pair of electrical contacts being mounted on said third conductive arm;

g. a second pair of normally closed, electrical contacts, one of said second pair of electrical contacts being mounted on said second conductive arm and the other of said second pair of electrical contacts being mounted on said first conductive arm;

h. an adjustable thermostat shaft assembly disposed to contact and selectively urge the cut-out portion in said second conductive arm in a downward direction towards said third conductive arm so as to open said first pair of electrical contacts;

i. an insulated button mounted on said actuator blade, said insulated button being disposed to contact and selectively urge said third conductive arm towards said first conductive arm so as to open said first pair of electrical contacts; and j. a tip-over device mounted on said actuator blade, said tip-over device being disposed to selectively urge said first conductive arm away from said second conductive arm so as to open said second pair of electrical contacts.

* * * * *